US007220195B1

(12) United States Patent
Cronin

(10) Patent No.: US 7,220,195 B1
(45) Date of Patent: May 22, 2007

(54) BAT METHOD OF CHOKING UP ON A BAT

(76) Inventor: Maurice F. Cronin, 345 Groton St., Dunstable, MA (US) 01827

( * ) Notice: Subject to any disclaimer, the term of this patent is extended or adjusted under 35 U.S.C. 154(b) by 0 days.

(21) Appl. No.: 11/178,102

(22) Filed: Jul. 11, 2005

(51) Int. Cl.
*A63B 59/06* (2006.01)

(52) U.S. Cl. ..... 473/568

(58) Field of Classification Search ..... 473/564–568, 473/519, 520, 457, 300–303, 549–552
See application file for complete search history.

(56) References Cited

U.S. PATENT DOCUMENTS

| | | | | |
|---|---|---|---|---|
| 2,659,605 | A * | 11/1953 | Letourneau | 473/568 |
| 2,984,486 | A | 5/1961 | Jones | |
| 5,035,428 | A | 7/1991 | Bartkowicz | |
| 5,193,246 | A * | 3/1993 | Huang | 16/421 |
| 5,238,246 | A | 8/1993 | Erb | |
| 5,342,046 | A | 8/1994 | Erb | |
| 5,611,533 | A * | 3/1997 | Williams | 473/568 |
| 5,839,983 | A * | 11/1998 | Kramer | 473/568 |
| 6,234,924 | B1 * | 5/2001 | Washburn, Jr. | 473/568 |
| D448,131 | S | 9/2001 | Ver Haar | |
| 2001/0031674 | A1 * | 10/2001 | McGinnis | 473/451 |
| 2004/0050205 | A1 * | 3/2004 | Putnam | 74/558 |

* cited by examiner

*Primary Examiner*—Mark S. Graham

(57) ABSTRACT

A bat gripping apparatus includes a panel that has a top side, a bottom side, a first side edge, a second side edge, a top edge and a bottom edge. The panel comprises a plurality of layers. The plurality of layers at least includes a bottom layer, a middle layer and a top layer. A coupler is configured to selectively secure the panel in a tubular configuration. A bat has a handle terminating in a butt. The panel is extended around the handle so that the bottom side abuts the bat and the bottom edge is positioned adjacent to the butt and the tubular configuration is attained. The panel is then secured in the tubular configuration with the coupler.

11 Claims, 3 Drawing Sheets

BAT METHOD OF CHOKING UP ON A BAT

BACKGROUND OF THE INVENTION

1. Field of the Invention

The present invention relates to bat gripping devices and more particularly pertains to a new bat gripping device for aiding a person in choking up on a bat to reduce the overall effective length of the bat.

2. Description of the Prior Art

The use of bat gripping aids is known in the prior art. U.S. Pat. No. 5,268,246 describes a device which is positionable around a bat to aid a person in gripping the bat. Another type of bat gripping device is U.S. Pat. No. 5,611,533 again includes a device extendable around a bat for improving the grip of a bat. Still yet another such device is found U.S. Pat. No. 5,342,046.

While these devices fulfill their respective, particular objectives and requirements, the need remains for a device which forms a false butt of the bat to assist a person in properly choking up on the bat. Most batters, and particularly children, inherently move there hands down to the butt of a bat when gripping a bat. For this reason, the device should be easily positionable around a bat adjacent to the butt of the bat so that a person holding the bat may use an edge of the device as a false butt for guiding their hands to a proper position.

SUMMARY OF THE INVENTION

The present invention meets the needs presented above by generally comprising a panel that has a top side, a bottom side, a first side edge, a second side edge, a top edge and a bottom edge. The panel comprises a plurality of layers. The plurality of layers at least includes a bottom layer, a middle layer and a top layer. The bottom layer comprises an elastomeric material, the middle layer comprises a gel material, and the top layer comprises a cloth material. A coupler is configured to selectively secure the panel in a tubular configuration. A bat has a handle terminating in a butt. The panel is extended around the handle so that the bottom side abuts the bat and the bottom edge is positioned adjacent to the butt and the tubular configuration is attained. The panel is then secured in the tubular configuration with the coupler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
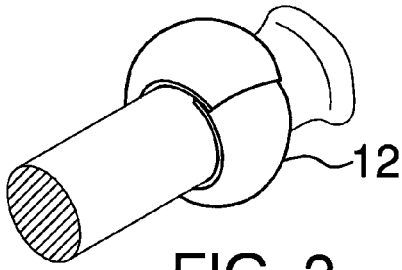
FIG. 2 is a perspective view of a second shape of the present invention.

With reference now to the drawings, and in particular to FIGS. 1 through 9 thereof, a new bat gripping device embodying the principles and concepts of the present invention and generally designated by the reference numeral 10 will be described.

Figure 3:
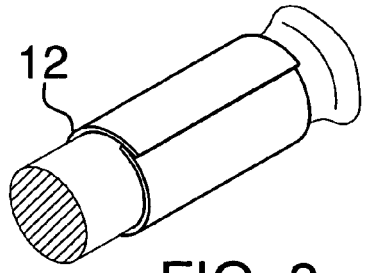
FIG. 3 is a perspective view of a third shape of the present invention.
Figure 1:
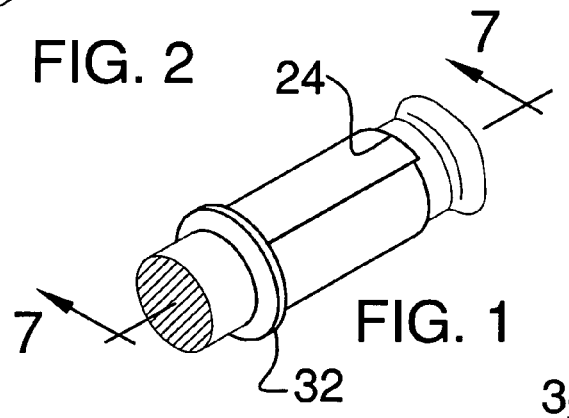
FIG. 1 is a perspective view of a first shape of a panel of a method of choking up on a bat according to the present invention.
Figure 4:
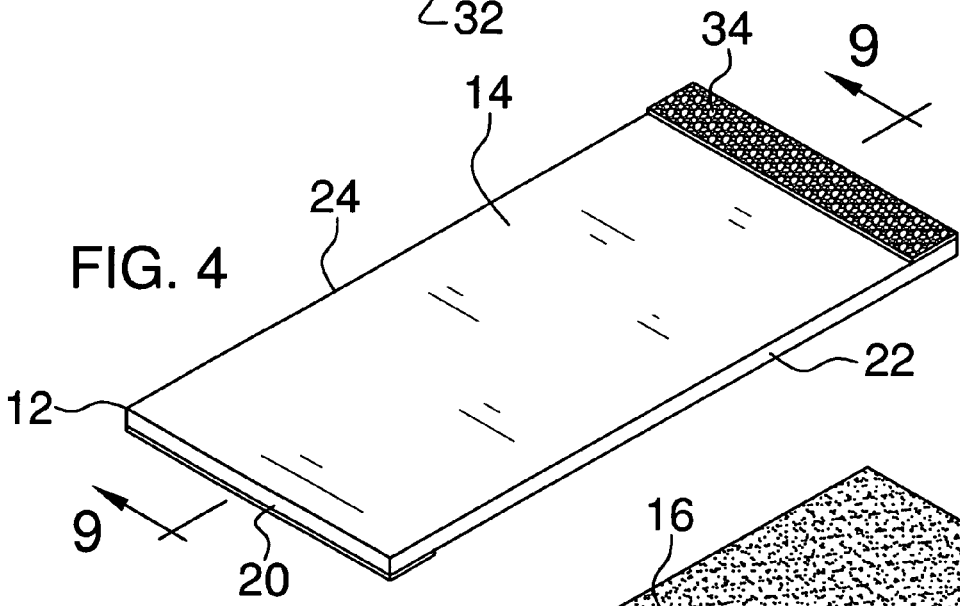
FIG. 4 is a top perspective view of a first embodiment of the present invention.
Figure 5:
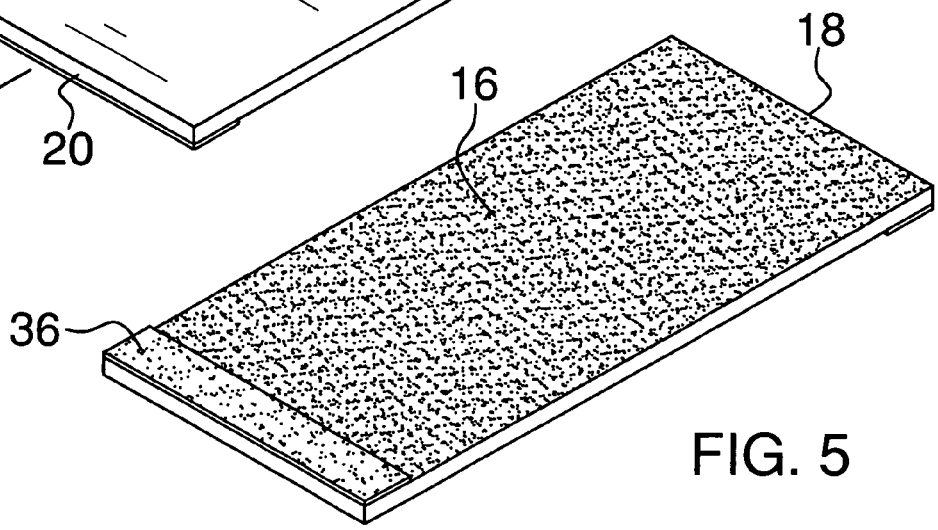
FIG. 5 is a bottom view of the first embodiment of the present invention.
Figure 6:
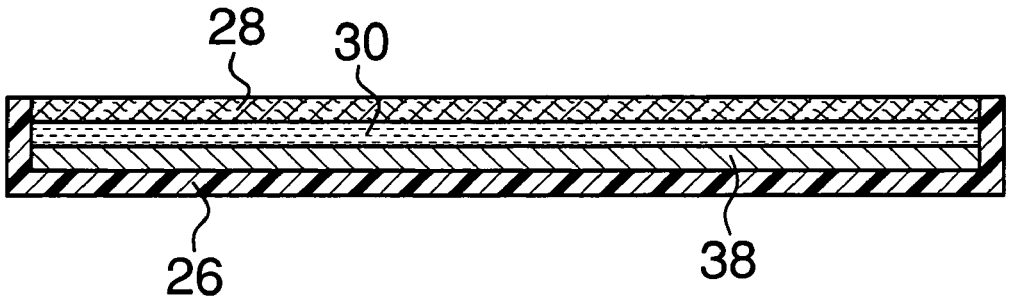
FIG. 6 is a cross-sectional view of a second embodiment of the present invention.
Figure 7:
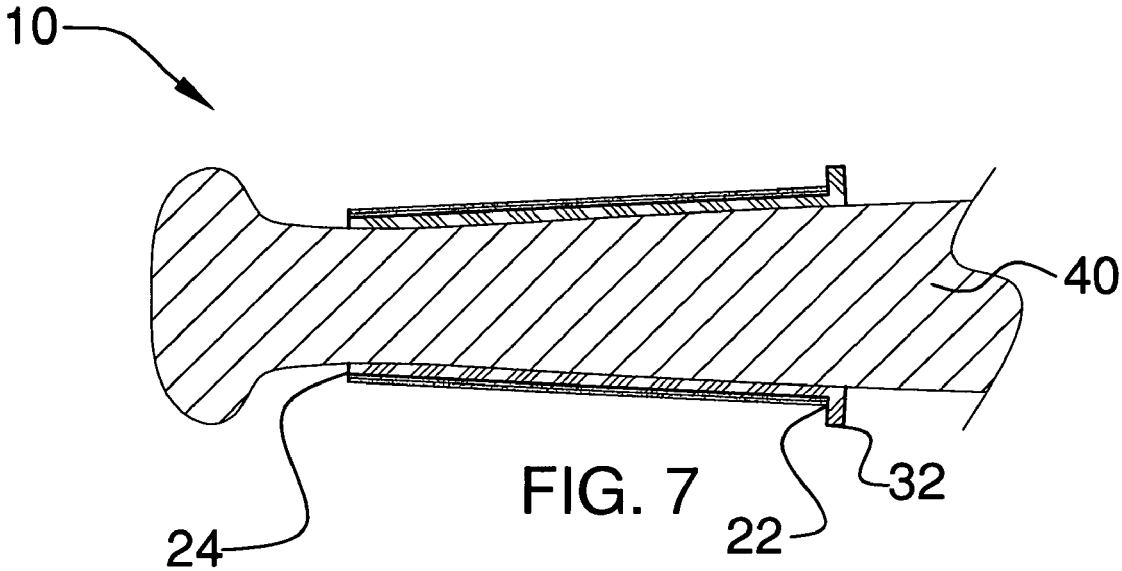
FIG. 7 is a cross-sectional view taken along line 1—1 of the first embodiment of the present invention.
Figure 8:
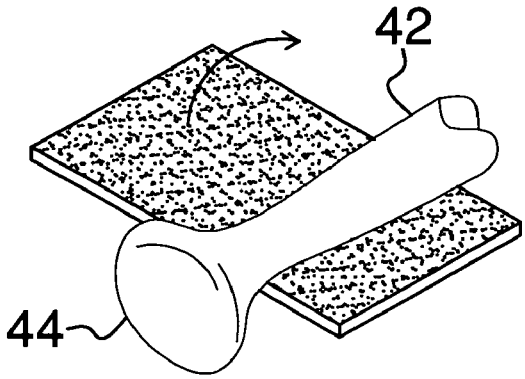
FIG. 8 is a bottom perspective view of the second embodiment of the present invention.
Figure 9:
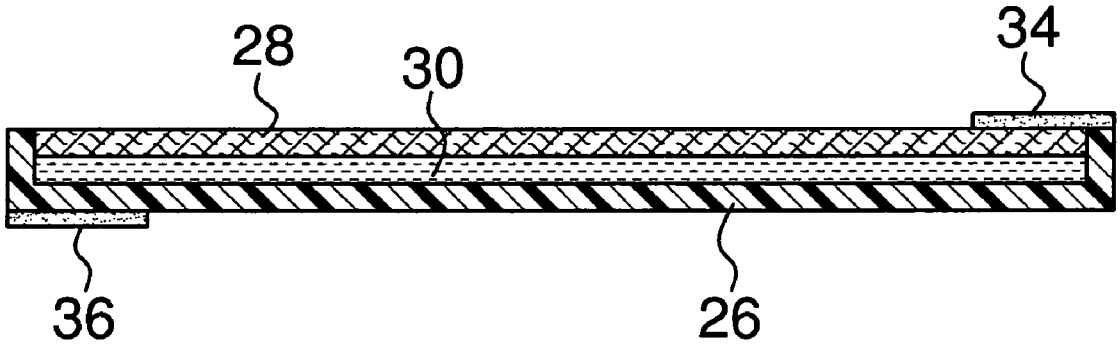
FIG. 9 is a cross-sectional view taken along line 9—9 of FIG. 4 of the present invention.

FIGS. 1–3 show variations of the device as to its outer shape whereas FIGS. 4 and 5 show a first embodiment of materials and FIG. 6 and show a second embodiment of materials. As best illustrated in FIGS. 1 through 9, the bat method of choking up on a bat 10 generally comprises a panel 12 that has a top side 14, a bottom side 16, a first side edge 18, a second side edge 20, a top edge 22 and a bottom edge 24. The panel 12 comprises a plurality of layers. The plurality of layers includes at least a bottom layer 26 positioned adjacent to the bottom side 16, a top layer 28 positioned adjacent to the top side 14 and a middle layer 30 positioned between the top 28 and bottom 26 layers. The bottom layer 26 comprises an elastomeric material and the middle layer comprises 30 a conventional a gel material used for cushioning. The top layer 28 comprises a cloth material which is preferably a synthetic cloth material, such as nylon. A lip 32 is attached to and extends along a length of the top edge 22. The lip 32 extends upwardly from the top side and is comprised of an elastomeric material. The top 28, bottom 26 and middle 30 layers may be held together with an adhesive, or secured together along their edges. The gel layer may be positioned within a flexible container. The panel in FIG. 2 has a convex outer surface and may be comprised of shape memory material such as an elastomer.

A coupler is configured to selectively secure the panel 12 in a tubular configuration. In the first embodiment of FIGS. 4 and 5, the coupler comprises a hook and loop coupler that includes a first mating member 34 and a second mating member 36. The first mating member 34 is attached to the top side 14 and extends along the first side edge 18. The second mating member 36 is attached to the bottom side 16 and extends along the second side edge 20. The coupler of the second embodiment includes a memory retention plate 38 positioned between the bottom 26 and middle 30 layers. The memory retention plate 38 comprises a resiliently bendable material, such as a plastic or metal, which is configured to retain a tubular shape. The memory retention plate 38 of this type can typically be opened up and popped into a concave shape and then the process is reversed to pop the plate 38 into a tubular shape.

A bat 40 is included which has a handle 42 terminating in a butt 44. The panel 12 is extended around the handle 42 so that the bottom side 16 abuts the bat 40 and the bottom edge is positioned adjacent to the butt 44 and the tubular configuration is attained. The panel 12 is then secured in the tubular configuration with the coupler. A person then places their hands adjacent to the top edge so that the panel 12 acts as butt extension for the bat 12 and assists the person in choking up on the bat.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of choking up on a bat comprising the steps of:

providing a panel having a top side, a bottom side, a first side edge, a second side edge, a top edge and a bottom edge, said panel comprising a plurality of layers, said plurality of layers at least including a bottom layer, a middle layer and a top layer, said bottom layer comprising an elastomeric material, said middle layer comprising a gel material, said top layer comprising a cloth material;

providing a lip being attached to and extending along a length of said top edge, said lip extending upwardly from said top side;

providing a coupler configured to selectively secure said panel in a tubular configuration;

providing a bat having a handle terminating in a butt;

extending said panel around said handle such that said bottom side abuts the bat and said bottom edge is positioned adjacent to said butt and said tubular configuration is attained;

securing said panel in said tubular configuration with said coupler, said coupler comprising a memory retention plate positioned between said bottom and middle layers, said memory retention plate comprising a resiliently bendable material configured to retain a tubular shape; and positioning hands of a person on the bat and against the lip so that the panel is positioned between the hands and the butt of the bat.

2. The method according to claim 1, wherein said cloth material is a synthetic cloth material.

3. The method according to claim 1, wherein said lip is comprised of an elastomeric material.

4. A method of choking up on a bat comprising the steps of:

providing a panel having a top side, a bottom side, a first side edge, a second side edge, a top edge and a bottom edge, said panel comprising a plurality of layers, said plurality of layers at least including a bottom layer and a top layer, said bottom layer comprising an elastomeric material and said top layer comprises a cloth material;

providing a coupler configured to selectively secure said panel in a tubular configuration, said coupler comprising a memory retention plate positioned between said bottom and top layers, said memory retention plate comprising a resiliently bendable material configured to retain a tubular shape;

providing a bat having a handle terminating in a butt;

extending said panel around said handle such that said bottom side abuts the bat and said bottom edge is positioned adjacent to said butt and said tubular configuration is attained;

securing said panel in said tubular configuration with said coupler; and positioning hands on the bat so that the panel is positioned between the hands and the butt of the bat.

5. The method according to claim 4, wherein said plurality of layers includes a middle layer comprising a gel material.

6. The method according to claim 4 further providing a lip being attached to and extending along a length of said top edge, said lip extending upwardly from said top side.

7. The method according to claim 6, wherein said lip is comprised of an elastomeric material.

8. A method of choking up on a bat comprising the steps of:

providing a panel having a top side, a bottom side, a first side edge, a second side edge, a top edge and a bottom edge, said panel comprising a plurality of layers, said plurality of layers at least including a bottom layer and a top layer;

a lip being attached to and extending along a length of said top edge, said lip extending upwardly from said top side, providing a coupler configured to selectively secure said panel in a tubular configuration, said coupler comprising a memory retention plate positioned between said bottom and top layers, said memory retention plate comprising a resiliently bendable material configured to retain a tubular shape;

providing a bat having a handle terminating in a butt;

extending said panel around said handle such that said bottom side abuts the bat and said bottom edge is positioned adjacent to said butt and said tubular configuration is attained;

securing said panel in said tubular configuration with said coupler; and positioning hands on the bat so that the panel is positioned between the hands and the butt of the bat.

9. The method according to claim 8, wherein said bottom layer comprises an elastomeric material and said top layer comprises a cloth material.

10. The method according to claim 8, wherein said plurality of layers includes a middle layer comprising a gel material.

11. The method according to claim 8, wherein said lip is comprised of an elastomeric material.

* * * * *